US008944575B2

(12) United States Patent
Yokozawa et al.

(10) Patent No.: US 8,944,575 B2
(45) Date of Patent: Feb. 3, 2015

(54) PRESSURE-REGULATING VALVE AND LIQUID DROPLET EJECTION APPARATUS HAVING THE SAME

(75) Inventors: Toshihiro Yokozawa, Shiojiri (JP); Takahiro Yamashita, Matsumoto (JP); Seiji Kinoshita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1418 days.

(21) Appl. No.: 12/689,571

(22) Filed: Jan. 19, 2010

(65) Prior Publication Data

US 2010/0208001 A1 Aug. 19, 2010

(30) Foreign Application Priority Data

Feb. 19, 2009 (JP) ..... 2009-036388

(51) Int. Cl.
*B41J 2/175* (2006.01)

(52) U.S. Cl.
CPC ..... *B41J 2/175* (2013.01); *B41J 2/17596* (2013.01)
USPC ..... 347/85

(58) Field of Classification Search
None
See application file for complete search history.

(56) References Cited

U.S. PATENT DOCUMENTS

| | | | | |
|---|---|---|---|---|
| 7,655,992 | B2 | 2/2010 | Takahashi et al. | |
| 2005/0073559 | A1 * | 4/2005 | Aruga et al. | 347/85 |
| 2009/0151797 | A1 | 6/2009 | Nakamura et al. | |

FOREIGN PATENT DOCUMENTS

| | | | | |
|---|---|---|---|---|
| JP | 2005-309983 | A | 11/2005 | |
| JP | 2006-79171 | A | 3/2006 | |
| JP | 2006-153203 | * | 6/2006 | F16K 1/38 |
| JP | 2006-153203 | A | 6/2006 | |
| JP | 2006-163733 | A | 6/2006 | |
| JP | 2007-58616 | A | 3/2007 | |

* cited by examiner

*Primary Examiner* — Geoffrey Mruk
(74) *Attorney, Agent, or Firm* — Global IP Counselors, LLP

(57) ABSTRACT

A pressure-regulating valve in which the pressure of a functional liquid fed to a primary chamber from a functional liquid feeding means is regulated by opening and closing a valve body, the functional liquid is fed to a secondary chamber, and the functional liquid is fed from the secondary chamber to an inkjet-type functional droplet ejection head; wherein the valve body has a valve body main body that directly opens and closes with respect to a valve seat, the valve body main body being provided to the primary chamber; and a valve holder including a holding part that holds the valve body main body and an actuating shaft that comes in contact with a pressure-receiving membrane, the actuating shaft extending concentrically through the communication flow passage from the holding part; the actuating shaft is formed so as to taper to a point toward the pressure-receiving membrane; and the communication flow passage is formed to have a complementary shape with respect to the actuating shaft.

4 Claims, 11 Drawing Sheets

PRESSURE-REGULATING VALVE AND LIQUID DROPLET EJECTION APPARATUS HAVING THE SAME

CROSS-REFERENCE TO RELATED APPLICATIONS

The entire disclosure of Japanese Patent Application No. 2009-036388, filed Feb. 19, 2009 is expressly incorporated by reference herein.

BACKGROUND

1. Technical Field

The present invention relates to a pressure-regulating valve for properly vacuum-feeding a functional liquid to a functional droplet ejection head from a functional liquid feeding means; and to a liquid droplet ejection apparatus that is provided with the pressure-regulating valve.

2. Related Art

There is known a pressure-regulating valve for depressurizing a functional liquid of a sub tank to a predetermined pressure and feeding the functional liquid to a functional droplet ejection head, as described in Japanese Laid-open Patent Publication No. 2006-163733. This pressure-regulating valve is provided with a primary chamber communicating with an inflow port formed in a valve housing, and a secondary chamber communicating with an outflow port; a communication flow passage for communicating the primary chamber with the secondary chamber through a barrier; a valve body for opening and closing the communication flow passage from the primary chamber side, the edge of the opening of the communication flow passage on the primary chamber side being the valve seat; a diaphragm (pressure-receiving membrane) for forming one surface of the secondary chamber and opening and closing the valve body based on atmospheric pressure; and a valve body spring for urging the valve body in the closing direction. The valve housing, barrier, valve body, and other members constituting the pressure-regulating valve are formed of stainless steel or another corrosion-resistant metal in order to ensure solvent resistance and gas barrier properties with respect to the introduced functional liquid.

The valve body has an O-ring that comes in direct contact with the valve seat, and a valve holder that is formed by a holding part for holding the O-ring, and a shaft part that extends through the communication flow passage from the holding part. The communication flow passage is formed in a cruciform shape in cross-section, and the shaft part inserted through the communication flow passage is in contact with the diaphragm. Specifically, the valve body is opened and closed by the behavior of the diaphragm in a state in which the diaphragm and the valve body spring oppose each other.

However, in a pressure-regulating valve such as described above, although a small gap is formed between the communication flow passage and the shaft part of the valve body, since the communication flow passage is cruciform in cross-section, when the shaft of the valve body and the passage wall of the communication flow passage come in contact with each other as the valve body opens and closes, partial contact occurs and a relatively large sliding resistance is generated. Particularly because the wall of the communication flow passage and the shaft part of the valve body are both made of stainless steel or another metal, friction is high, the valve body is prevented from smoothly opening and closing, and the valve body no longer operates smoothly.

SUMMARY

An object of the present invention is to provide a pressure-regulating valve whereby the valve body can be smoothly opened and closed, and to provide a liquid droplet ejection apparatus provided with the pressure-regulating valve.

The pressure-regulating valve of the present invention includes a communication flow passage formed through a barrier that partitions a primary chamber and a secondary chamber inside a valve housing; a valve body that opens and closes the communication flow passage, an edge of a primary-chamber-side opening of the barrier in which the communication flow passage is formed being a valve seat; and a pressure-receiving membrane that forms one surface of the secondary chamber, and opens and closes the valve body based on atmospheric pressure; the pressure of a functional liquid fed to the primary chamber from functional liquid feeding means being regulated by opening and closing the valve body, the functional liquid is fed to the secondary chamber, and the functional liquid is fed from the secondary chamber to an inkjet-type functional droplet ejection head; wherein the valve body has a valve body main body that directly opens and closes with respect to the valve seat, the valve body main body being provided to the primary chamber; and a valve holder including a holding part that holds the valve body main body and an actuating shaft that comes in contact with the pressure-receiving membrane, the actuating shaft extending concentrically through the communication flow passage from the holding part; the actuating shaft is formed so as to taper to a point toward the pressure-receiving membrane; and the communication flow passage is formed to have a complementary shape with respect to the actuating shaft.

Preferably, the actuating shaft is inserted so that a small gap is formed with the communication flow passage in a closed-valve state in which the valve body main body is in close contact with the valve seat.

Through this configuration, since the actuating shaft is formed so as to taper to a point toward the pressure-receiving membrane, and the communication flow passage is formed having a complementary shape with respect to the actuating shaft, the actuating shaft moves away from the passage wall of the communication flow passage when the valve body is opened. Consequently, there is no large sliding resistance even when the actuating shaft touches the passage wall of the communication flow passage, and the valve body that opens and closes in conjunction with the movement of the pressure-receiving membrane can be smoothly actuated. Moreover, since the dimensions of the communication flow passage change according to the degree of opening of the valve body, in an operation whereby the functional liquid is forcibly suctioned from the functional droplet ejection head, for example, when the valve body is wide open, a correspondingly large quantity of functional liquid can be made to flow into the secondary chamber without resistance from the flow passage (without loss of pressure).

Preferably, the valve body main body includes an O-ring, and a retaining part of the valve body main body formed as an extension of the actuating shaft is formed at the boundary between the holding part and the actuating shaft.

Through this configuration, a retaining part for the O-ring can easily be formed using the tapered shape of the actuating shaft.

The liquid droplet ejection apparatus of the present invention is characterized in comprising the pressure-regulating valve described above, the functional liquid feeding means, and the functional droplet ejection head, wherein a functional liquid is ejected onto a workpiece and drawing is performed while the functional droplet ejection head is moved relative to the workpiece.

Through this configuration, the functional liquid can be stably fed at the appropriate pressure from the functional liquid feeding means to the functional droplet ejection head, and the quality of drawing on the workpiece by the functional droplet ejection head can be enhanced.

DETAILED DESCRIPTION OF EXEMPLARY EMBODIMENTS

A liquid droplet ejection apparatus provided with the pressure-regulating valve according to a first embodiment of the present invention will be described with reference to the accompanying drawings. This liquid droplet ejection apparatus is incorporated into a flat-panel display manufacturing line and uses a functional droplet ejection head into which a specialized ink or luminescent resin liquid is introduced as a functional liquid, and the liquid droplet ejection apparatus forms color filters of a liquid crystal display device or luminescent elements or the like as pixels of an organic EL display. A pressure-regulating valve vacuum feeds the functional liquid to the functional droplet ejection head at a constant pressure.

Figure 1:
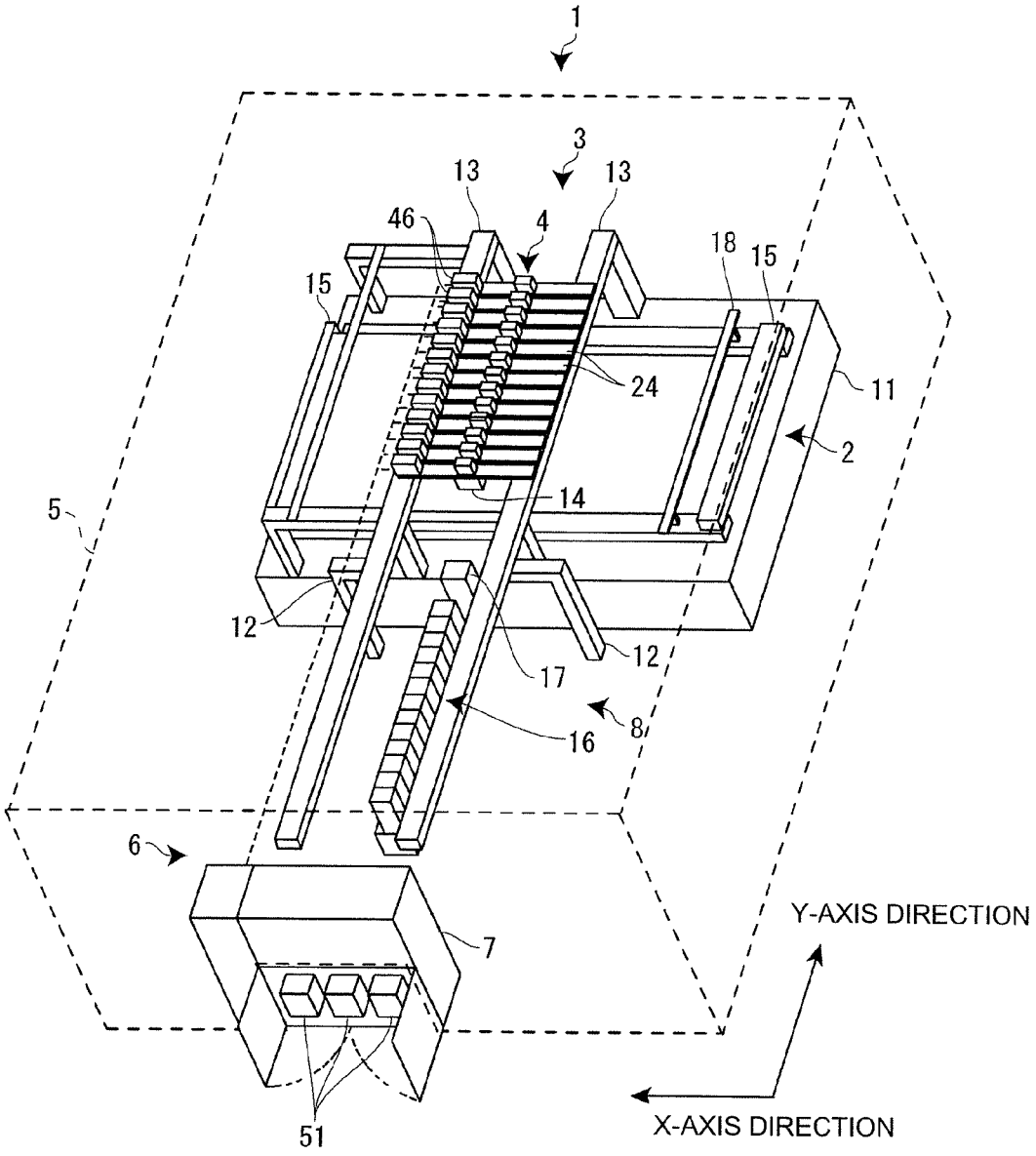
FIG. 1 is a perspective view showing the liquid droplet ejection apparatus.
Figure 2:
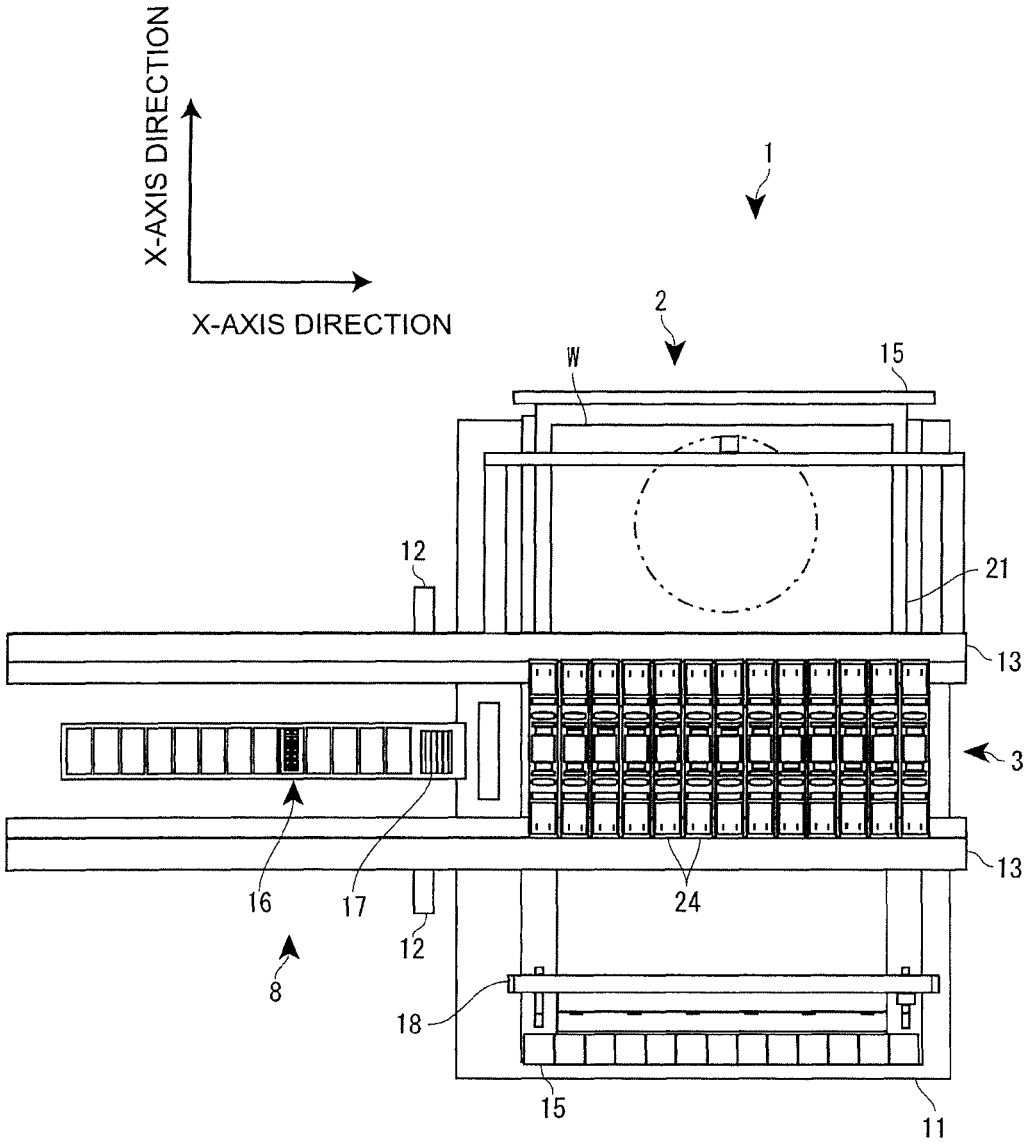
FIG. 2 is a plan view showing the liquid droplet ejection apparatus.
Figure 3:
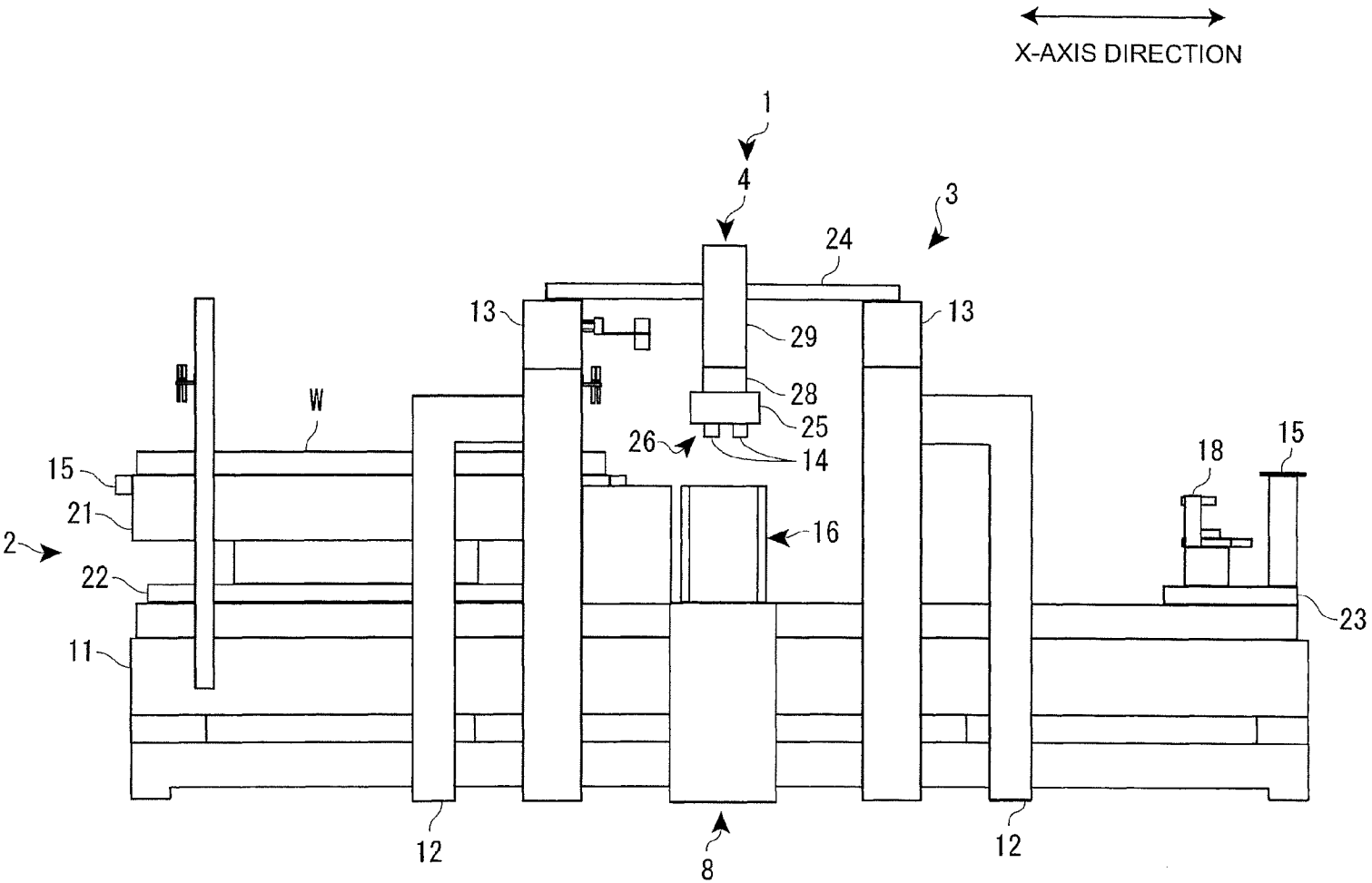
FIG. 3 is a side view showing the liquid droplet ejection apparatus.

As shown in FIGS. 1 through 3, the liquid droplet ejection apparatus 1 is composed of an X-axis table 2 for moving a workpiece W in the X-axis direction, the X-axis table 2 extending in the X-axis direction as the primary scanning direction and being provided on an X-axis support base 11 supported by a hard surface; a Y-axis table 3 extending in the Y-axis direction as a secondary scanning direction and being provided on a pair of Y-axis support bases 13 that are suspended over the X-axis table 2 via a plurality of support columns 12; and thirteen carriage units 4 in which a plurality (12) of functional droplet ejection heads 14 is mounted; and the thirteen carriage units 4 are suspended by the Y-axis table 3 so as to be able to move. The liquid droplet ejection apparatus 1 is further provided with a chamber 5 for housing the abovementioned devices in a temperature- and humidity-controlled atmosphere, and a functional liquid feeding unit 6 running through the chamber 5 for feeding functional liquid to the functional droplet ejection heads 14. A tank cabinet 7 for housing main tanks 51 for storing the functional liquid is provided to a portion of the side wall of the chamber 5. By driving the ejection of the functional droplet ejection heads 14 synchronously with the driving of the X-axis table 2 and the Y-axis table 3, the liquid droplet ejection apparatus 1 ejects the functional liquid fed from the functional liquid feeding unit 6, and draws a predetermined drawing pattern on the workpiece W.

The liquid droplet ejection apparatus 1 is also provided with a maintenance device 8 that has a flushing unit 15, a suction unit 16, a wiping unit 17, and an ejection performance detection unit 18. These units are provided to maintain the functional droplet ejection heads 14 and enable the functioning of the functional droplet ejection heads 14 to be maintained and restored. In the liquid droplet ejection apparatus 1 of the present embodiment, drawing on the workpiece W is performed with the carriage units 4 facing the area in which the X-axis table 2 and Y-axis table 3 intersect, and the performance of the functional droplet ejection heads 14 is maintained and restored with the carriage units 4 facing the area in which the Y-axis table 3 and maintenance device 8 (suction unit 16 and wiping unit 17) intersect.

As shown in FIGS. 2 and 3, the X-axis table 2 is provided with a setting table 21 for suction-setting the workpiece W; an X-axis first slider 22 for supporting the setting table 21 so that the setting table 21 is able to slide in the X-axis direction; an X-axis second slider 23 for supporting the abovementioned flushing unit 15 and ejection performance detection unit 18 so as to enable sliding thereof in the X-axis direction; and a pair of left and right X-axis linear motors (not shown) for moving the X-axis first slider 22 and X-axis second slider 23 in the X-axis direction, the X-axis linear motors extending in the X-axis direction.

The Y-axis table 3 is provided with thirteen bridge plates 24 from which the thirteen carriage units 4 are suspended; thirteen Y-axis sliders (not shown) for supporting the bridge plates 24 in straddled fashion; and a pair of Y-axis linear motors (not shown) for moving the bridge plates 24 in the Y-axis direction, the Y-axis linear motors being provided on the pair of Y-axis support bases 13. The Y-axis table 3 secondarily scans the functional droplet ejection heads 14 during drawing via the carriage units 4, as well as causes the functional droplet ejection heads 14 to face the suction unit 16 and the wiping unit 17. In this case, the carriage units 4 may each be moved separately, or the thirteen carriage units 4 may be moved integrally.

Figure 4:
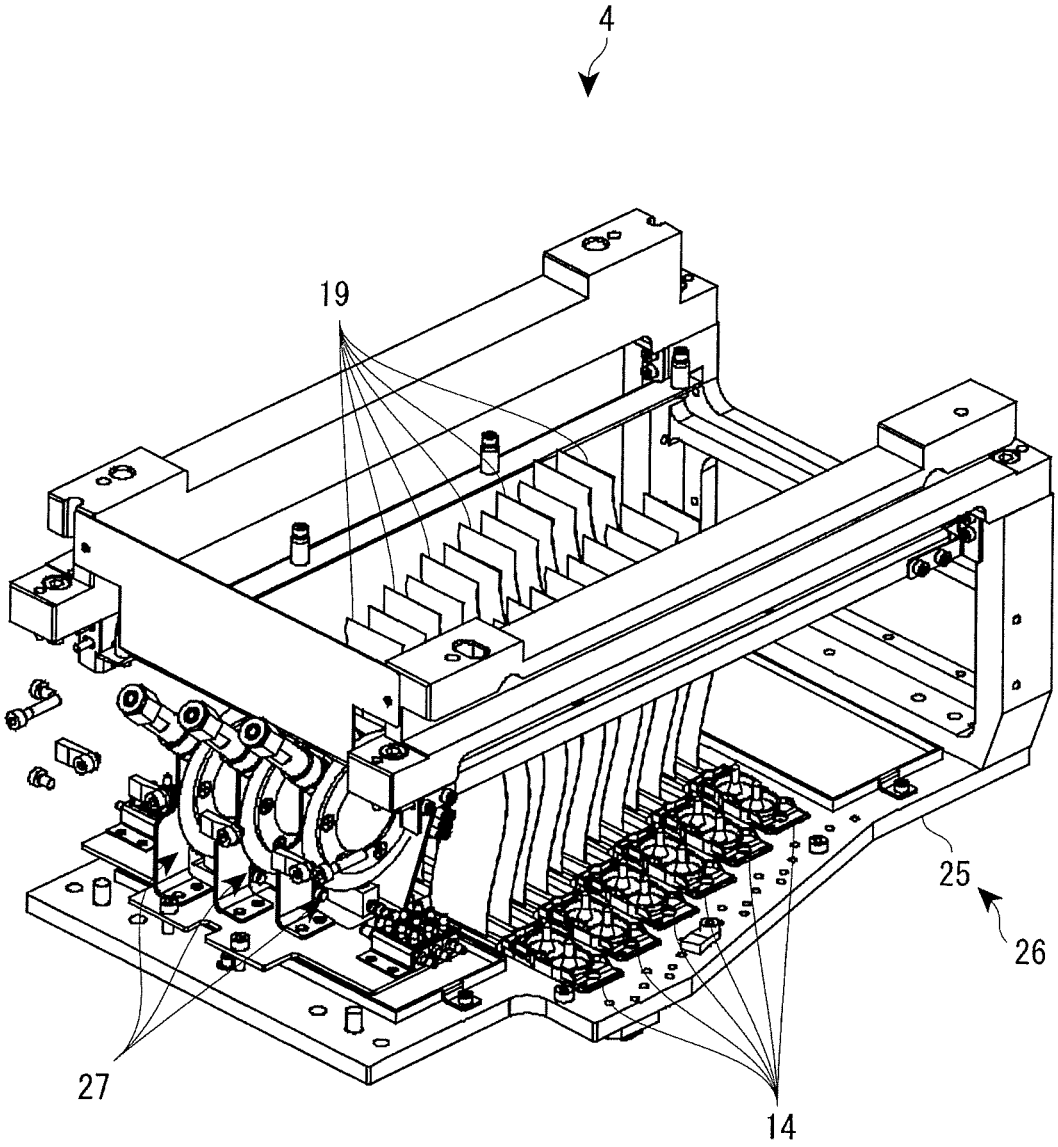
FIG. 4 is an external perspective view showing the carriage.

As shown in FIG. 4, the carriage units 4 are each provided with a head unit 26 composed of four (twelve in total) functional droplet ejection heads 14 for each of the three colors R, G, and B; and a head plate 25 for supporting the twelve functional droplet ejection heads 14 so that the functional droplet ejection heads 14 are divided into two groups of six heads each arranged in the same horizontal plane. The carriage units 4 are each provided with pressure-regulating valves 27 (described in detail hereinafter) for vacuum-feeding the functional liquid to the functional droplet ejection heads 14 based on atmospheric pressure; a θ rotation mechanism 28 for supporting the head unit 26 so as to enable θ correction (θ rotation) thereof; and a suspension member 29 (shown with the θ rotation mechanism 28 in FIG. 3) for causing the bridge plates 24 to support the head unit 26 via the θ rotation mechanism 28. Furthermore, the carriage units 4 are provided with sub tanks 46 (see FIG. 1) for temporarily storing the functional liquid (the sub tanks 46 actually being provided on the bridge plates 24), and the functional liquid is fed at a constant pressure to the functional droplet ejection heads 14 by the sub tanks 46 and the pressure-regulating valves 27.

Figure 5:
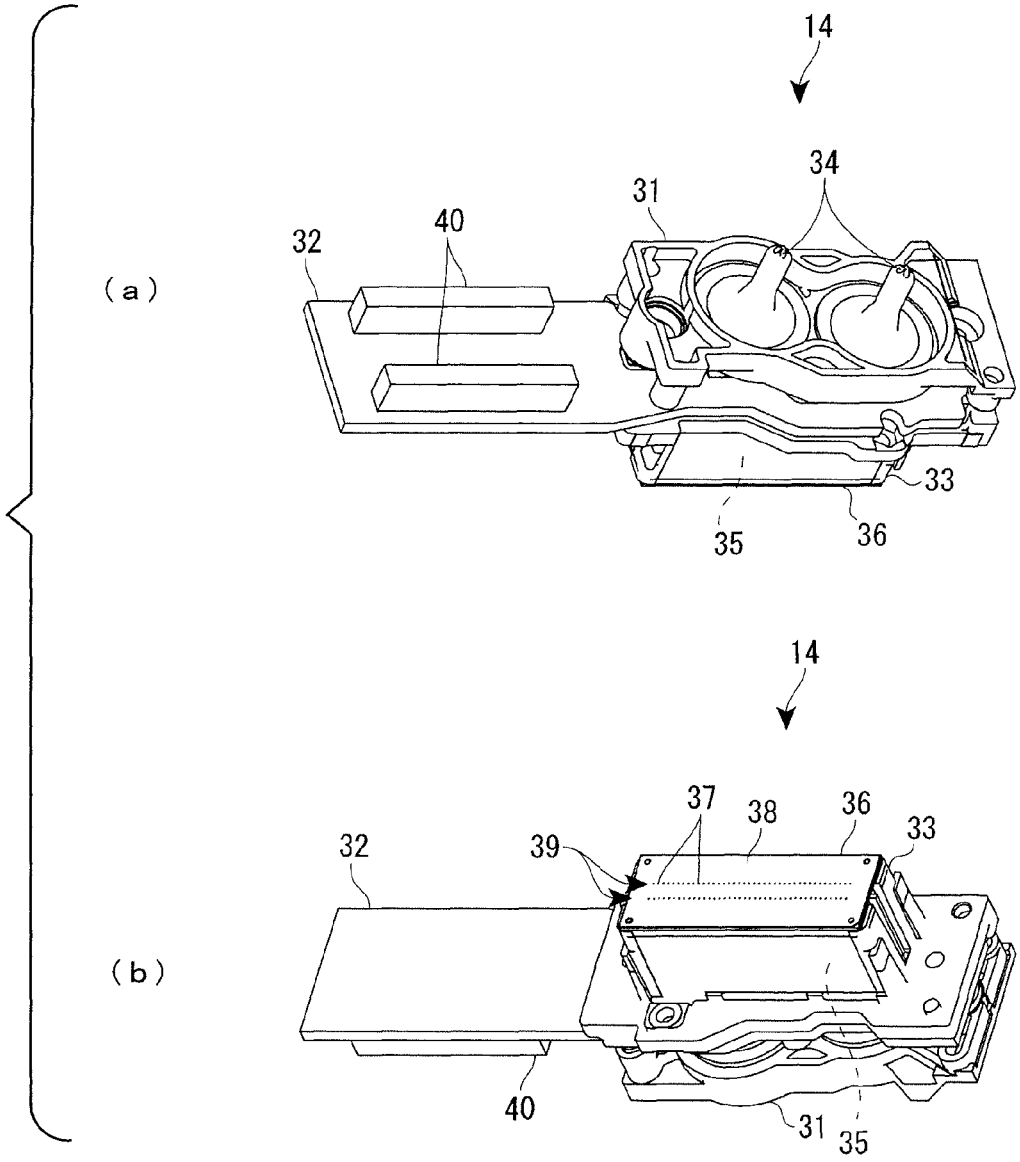
FIG. 5 is an external perspective view showing the front and back of the functional droplet ejection head.

As shown in FIG. 5, the functional droplet ejection head 14 is a so-called double inkjet head, and is provided with a functional liquid introduction part 31 having two connecting pins 34; a double head substrate 32 that is connected to the functional liquid introduction part 31; and a head body 33 for ejecting the functional liquid that is connected to the bottom of the head substrate 32 (see FIG. 5(*a*)). The functional liquid introduction part 31 has two connecting pins 34 that correspond to the number of nozzle rows 39, and the functional liquid from the sub tanks 46 is fed via a functional liquid feeding system 48 (see FIG. 6). The head body 33 has two pump parts 35 composed of piezoelectric elements or the like, and a nozzle plate 36 having a nozzle surface 38 in which a plurality of ejection nozzles 37 is formed. The numerous ejection nozzles 37 formed in the nozzle surface 38 of the nozzle plate 36 form two nozzle rows 39 arranged parallel to each other or at an offset of one-half nozzle pitch, and each of the nozzle rows 39 is composed of 180 ejection nozzles 37 arranged at an equal pitch (see FIG. 5(*b*)). Two connectors 40 are provided to the head substrate 32, and the connectors 40 are connected to a control device outside the drawing via flexible flat cables 19 (see FIG. 4). The drive waveform outputted from the control device is applied to the pump parts 35 (piezoelectric elements) via the connectors 40, and functional liquid is thereby ejected from the ejection nozzles 37.

Figure 6:
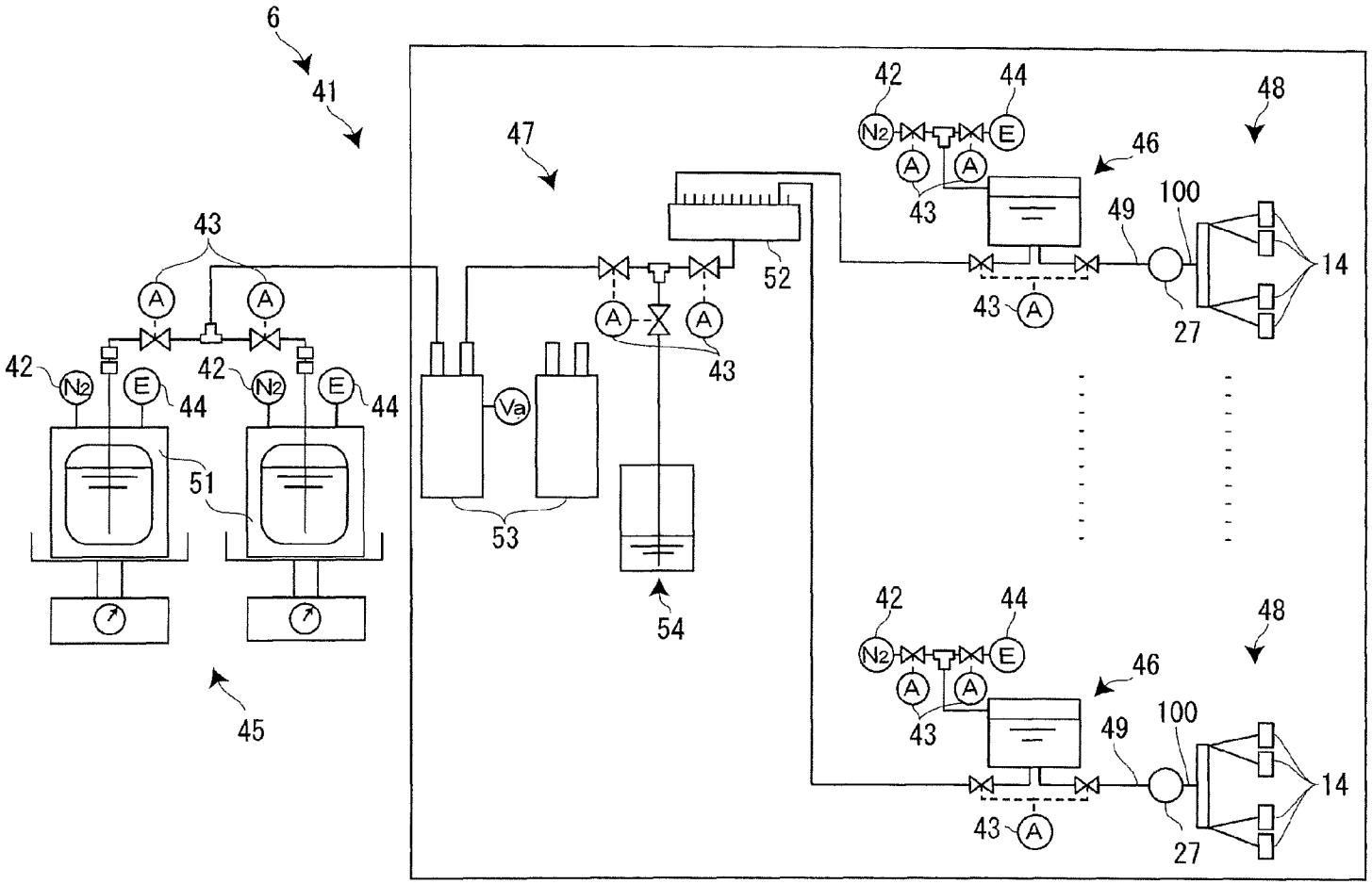
FIG. 6 is a schematic view showing the functional liquid feeding device.

The functional liquid feeding unit 6 will next be described with reference to FIG. 6. The functional liquid feeding unit 6 is provided with three functional liquid feeding devices (functional liquid feeding means) 41 corresponding to the three colors described above; nitrogen gas feeding equipment 42 for feeding compressed nitrogen gas used for control to the main tanks 51, the sub tanks 46, and other components; compressed air feeding equipment 43 for feeding compressed air used to control various opening and closing valves; and gas exhaust equipment 44 for handling the gas exhaust from each component. The three functional liquid feeding devices 41 are connected to functional droplet ejection heads 14 that correspond to the three colors, and the corresponding colors of functional liquid are thereby fed to the functional droplet ejection heads 14 of each color.

Each of the functional liquid feeding devices 41 is provided with a main tank unit 45 having two main tanks 51, 51 that constitute feeding sources for functional liquid; thirteen sub tanks 46 corresponding to the carriage units 4; an upstream functional liquid flow passage 47 for connecting the main tank unit 45 and the sub tanks 46; pressure-regulating valves 27 for vacuum-feeding the functional liquid from the sub tanks 46 to the functional droplet ejection heads 14; and thirteen downstream functional liquid flow passages 49 for connecting the sub tanks 46 and the pressure-regulating valves 27. The functional liquid in each of the main tanks 51 is pressurized by the compressed nitrogen gas from the nitrogen gas feeding equipment 42 connected to the main tanks 51, and the functional liquid is selectively fed via the upstream functional liquid flow passage 47 to the thirteen sub tanks 46 that are opened to atmospheric pressure via the gas exhaust equipment 44. The functional liquid of the sub tanks 46 is fed at a constant pressure to the functional droplet ejection heads 14 via the downstream functional liquid flow passages 49 and the pressure-regulating valves 27.

The upstream end of the upstream functional liquid flow passage 47 is connected to the main tank unit 45, and the downstream end is connected to the sub tanks 46 via a thirteen-branch flow passage 52. A bubble removal unit 53 for removing bubbles from the functional liquid, and an air outlet unit 54 for removing bubbles entrained in the upstream functional liquid flow passage 47 on the upstream side are provided to the upstream functional liquid flow passage 47 in sequence from the upstream side. The functional liquid fed from the main tank unit 45 is divided into thirteen streams by the thirteen-branch flow passage 52 and fed to the sub tanks 46.

Figure 7:
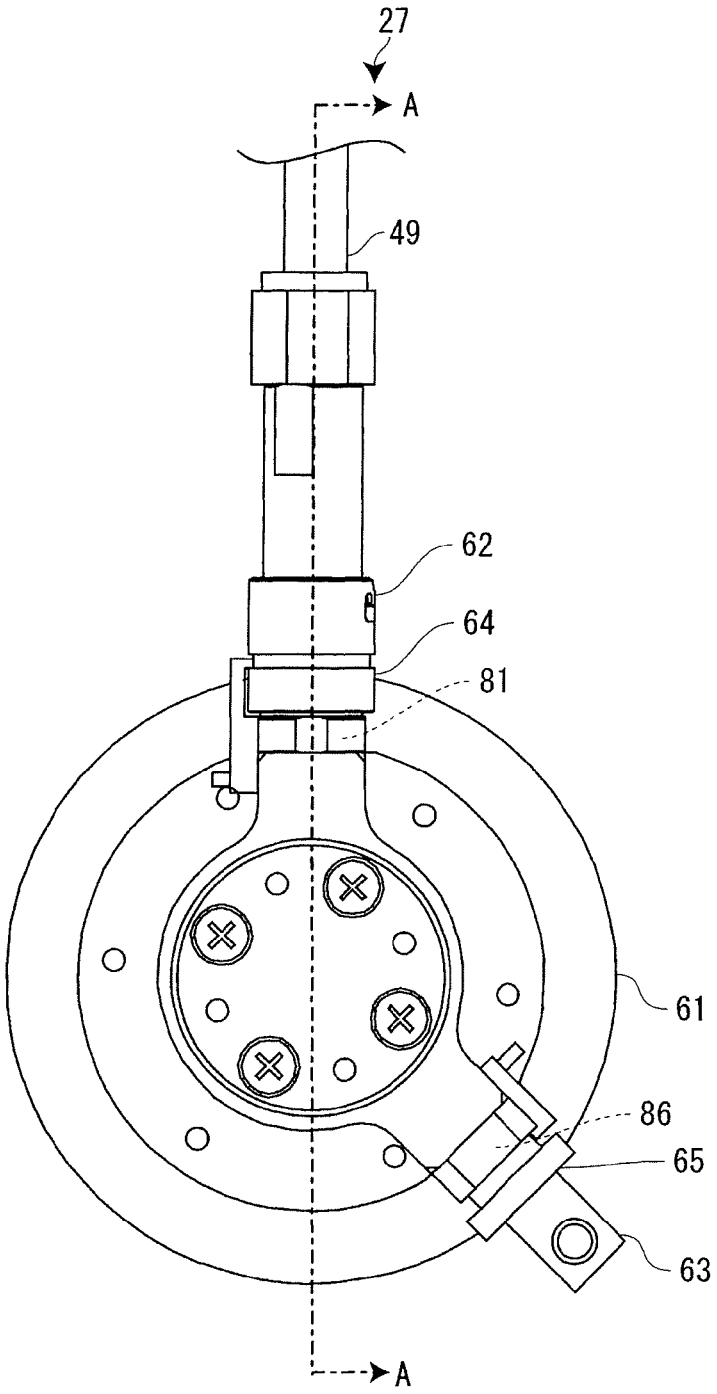
FIG. 7 is a pan view showing the pressure-regulating valve.
Figure 8:
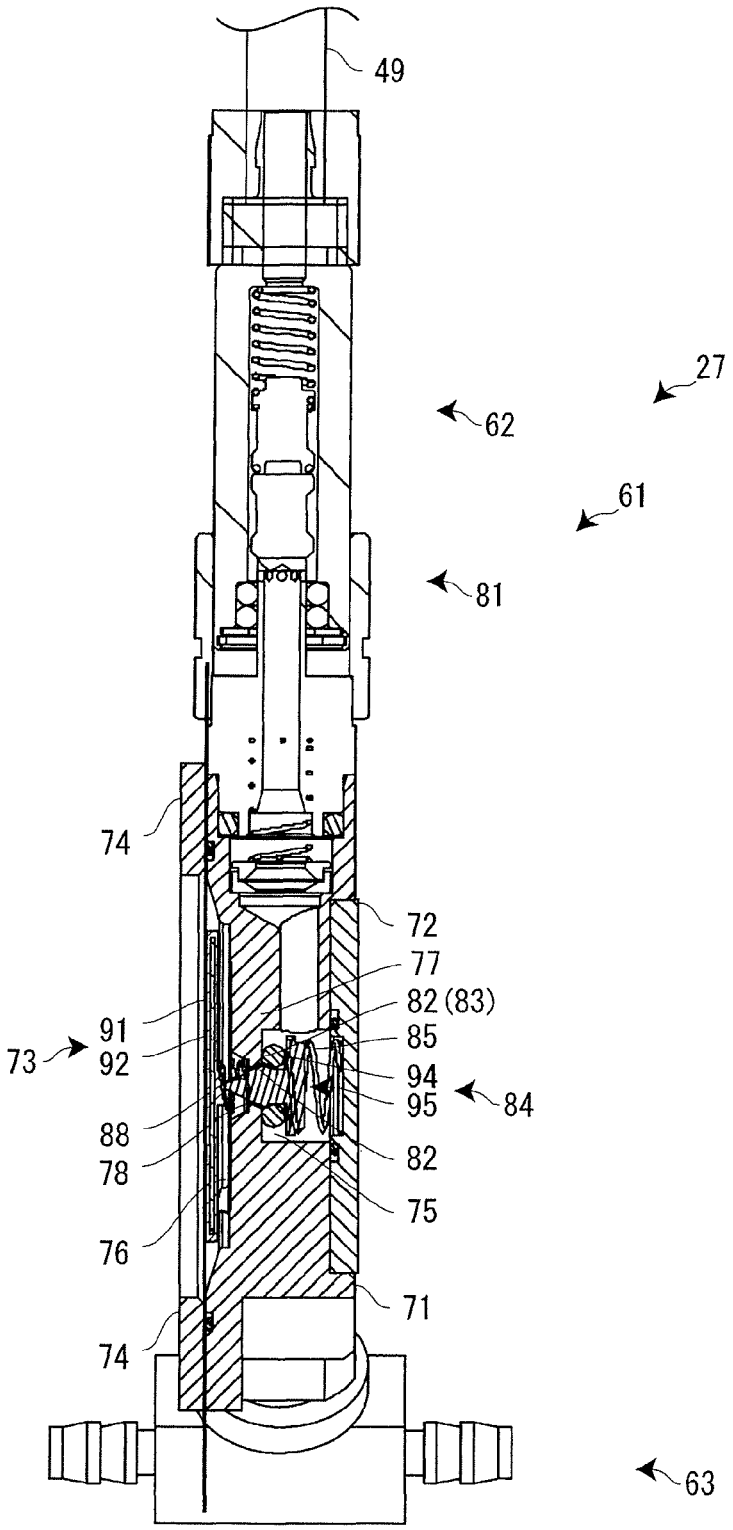
FIG. 8 is a sectional view along line A-A showing the pressure-regulating valve.

The pressure-regulating valve 27 will next be described with reference to FIGS. 7 through 9. The pressure-regulating valve 27 is provided with a regulating valve body 61 as the main component, an inflow connector 62 inserted into and bonded to the inflow side of the regulating valve body 61, and an outflow connector 63 inserted into and bonded to the outflow side of the regulating valve body 61. A downstream functional liquid flow passage 49 connected to a sub tank 46 is connected to the inflow connector 62 via an inflow-side presser nut 64, and a head connection tube 100 connected to the functional droplet ejection heads 14 is connected to the outflow connector 63 via an outflow-side presser nut 65.

The regulating valve body 61 (pressure-regulating valve 27) is composed of a valve housing 71 in which a depression is formed in the center of the front surface and rear surface thereof; a cover 72 for partitioning the valve housing 71 and a primary chamber 75; and a membrane presser member 74 for partitioning the valve housing 71 and a secondary chamber 76 by fixing a pressure-receiving membrane 73 to the valve housing 71. The primary chamber 75 and the secondary chamber 76 are provided on the same axis via a barrier 77 that forms a portion of the valve housing 71, and a communication flow passage 78 for communicating the primary chamber 75 and the secondary chamber 76 is formed through the center (axial center) of the barrier 77.

The primary chamber 75 is formed by the cover 72 and the rear surface of the valve housing 71 having the barrier 77 as the main body thereof. An inflow port 81 extending at an angle in the radial direction from the primary chamber 75 is formed at the top of the primary chamber 75, and a primary-chamber-side opening 82 connected to the communication flow passage 78 is formed in the center of the primary chamber 75. A valve body 84 for opening and closing the communication flow passage 78 from the side of the primary chamber 75 faces the primary-chamber-side opening 82, while correspondingly, a valve seat 83 against which the valve body 84 moves is formed by the circumferential edge of the primary-chamber-side opening 82. The valve body 84 is weakly urged in the closing direction (toward the secondary chamber 76) by an engaged valve body urging spring 85.

The secondary chamber 76 is formed by the pressure-receiving membrane 73 and the front surface of the valve housing 71. An outflow port 86 extending directly downward is formed at the bottom of the secondary chamber 76, and a secondary-chamber-side opening 87 connected to the communication flow passage 78 is formed in the center of the secondary chamber 76. A membrane urging spring 88 for urging the pressure-receiving membrane 73 in the forward direction is also provided between the pressure-receiving membrane 73 and the circumferential edge of the secondary-chamber-side opening 87.

The pressure-receiving membrane 73 is composed of a membrane body 91 made of a resin film, and a resin pressure-receiving plate 92 bonded to the center portion of the membrane body 91. The pressure-receiving plate 92 is formed in a circular plate shape concentric with the membrane body 91 and having an adequately small diameter with respect to the membrane body 91, and the valve body 84 comes in contact with the center of the pressure-receiving plate 92.

The communication flow passage 78 is formed so as to pass from the orthogonal direction through the barrier 77 that constitutes the central portion of the valve housing 71, as described above. The communication flow passage 78 is formed in a tapering shape so that the primary-chamber-side opening 82 thereof has a large diameter, and the secondary-chamber-side opening 87 thereof has a small diameter. Although described in detail hereinafter, an actuating shaft 99 of the valve body 84 that is inserted into the communication flow passage 78 is formed so as to taper to a point, and the communication flow passage 78 is formed having a complementary shape with respect to the actuating shaft 99.

Figure 9:
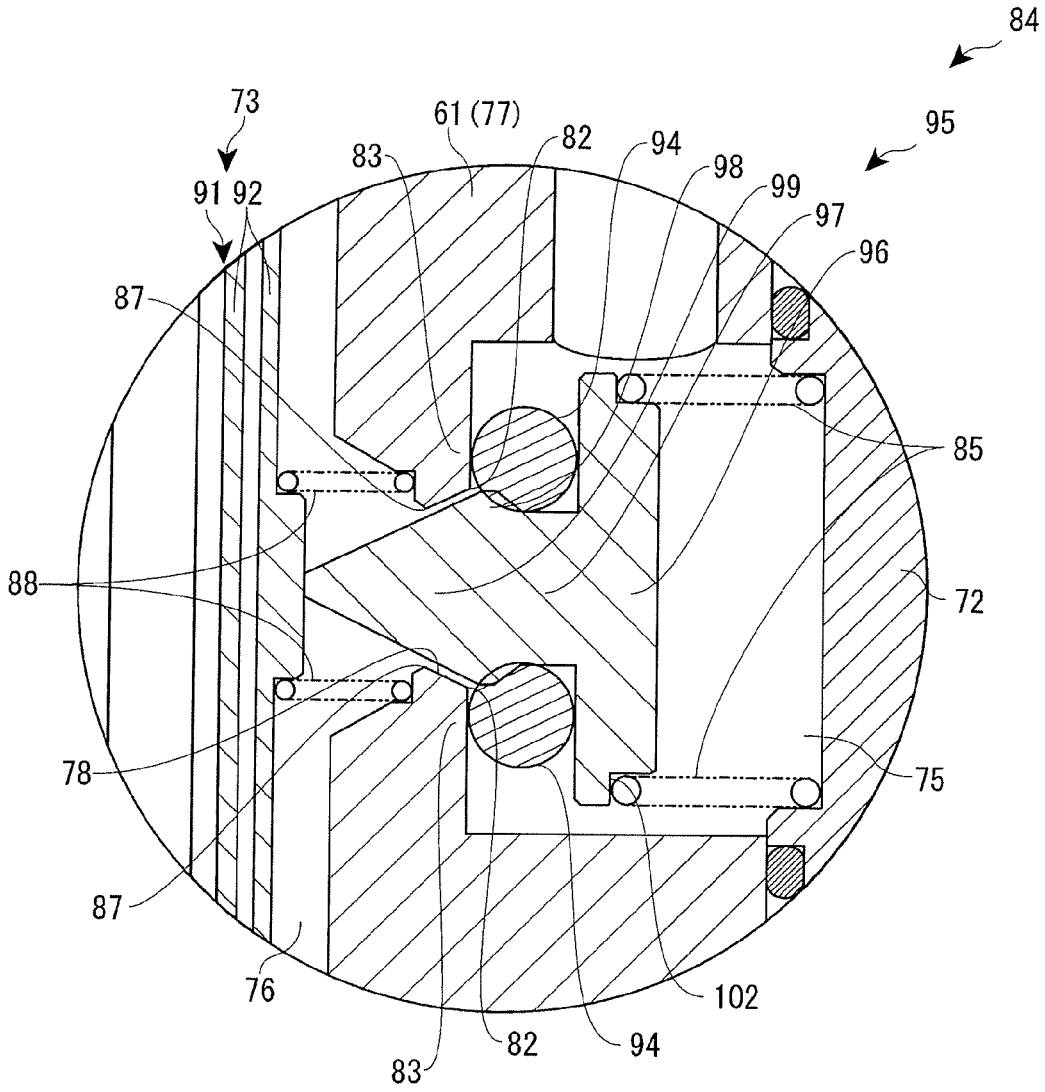
FIG. 9 is an enlarged view showing the area around the valve body.

The valve body 84 is provided with a valve main body 94 for functioning as a valve, and a valve holder 95 for holding the valve main body 94, as shown in FIG. 9. The valve body 84 opens and closes by separating from and contacting the circumferential edge of the primary-chamber-side opening 82 as the valve seat 83 based on atmospheric pressure by the pressure-receiving membrane 73, and functional liquid intermittently flows into the secondary chamber 76 from the primary chamber 75 as this opening and closing is repeated.

The valve main body 94 is a so-called O-ring composed of a chemical resistant perfluoro rubber material, and is harder than the silicone rubber valve main body 94 that is normally used. The front end portion of the valve main body 94 that is installed in the valve holder 95 separates from and contacts the valve seat 83 to function as a valve.

The valve holder 95 is substantially T-shaped in cross-section, and is composed of the following components arranged on the same axis in sequence from the rear in the axial direction: a thick round plate-shaped holder base 96 with which the valve body urging spring 85 is engaged; a holding part 97 for directly retaining the valve main body 94, the holding part 97 being connected to the holder base 96; a retaining part 98 for holding the valve main body 94 in a retained state, the retaining part 98 being connected to the holding part 97; and an actuating shaft 99 that extends from the distal end of the retaining part 98. The valve main body 94 is installed over the retaining part 98 from the side of the actuating shaft 99. The actuating shaft 99 (valve holder 95) is inserted in the communication flow passage 78, and the distal end thereof is in contact with the pressure-receiving plate 92 (pressure-receiving membrane 73). The holding part referred to in the claims is composed of the holder base 96 and holding part 97 described above.

The holder base 96 is formed in a round plate shape and forms a pressure-receiving part on the side of the primary chamber 75, and an annular spring bearing 102 in which the valve body urging spring 85 is engaged is formed on the back surface thereof. The holder base 96 receives the pressure of the primary chamber 75 on the back surface thereof, and is weakly urged in the closing directly by the valve body urging spring 85.

The holding part 97 is connected to the holder base 96 and formed having a diameter slightly larger than the inside diameter of the valve main body 94, and the length of the holding part 97 is such that the holding part 97 does not protrude farther than the front end of the valve main body 94 when the valve main body 94 is installed.

The retaining part 98 is composed of a step portion connected to the distal end of the holding part 97, and holds the valve main body 94 in a retained state, leaving a small portion of the valve main body 94 to make contact with the valve seat 83. Specifically, the front end of the retaining part 98 is set behind the front end of the valve main body 94, and is a portion extended from the actuating shaft 99 and formed with a diameter slightly larger than the inside diameter of the valve main body 94.

The actuating shaft 99 is formed so as to taper to a point from the distal end of the wide-diameter retaining part 98, and the distal end of the actuating shaft 99 is flat or hemispherical (not shown) so as to receive the pressure from the pressure-receiving plate 92. The actuating shaft 99 is inserted in the abovementioned communication flow passage 78 from the primary chamber 75 side, and the shape of the communication flow passage 78 is complementary to that of the actuating shaft 99. In the closed state in which the valve main body 94 is in contact with the valve seat 83, a small gap is formed between the actuating shaft 99 and the passage wall of the communication flow passage 78, and in the valve closing operation described hereinafter, the actuating shaft 99 does not touch the passage wall before the valve main body 94 comes in contact with the valve seat 83. When the valve main body 94 is opened from this state, and the actuating shaft 99 is retracted, a flow passage having an adequate cross-sectional area is maintained between the actuating shaft 99 and the passage wall of the communication flow passage 78. In this case, the size of the flow passage between the actuating shaft 99 and the passage wall changes in proportion to the stroke of the valve body 84.

Figure 10:
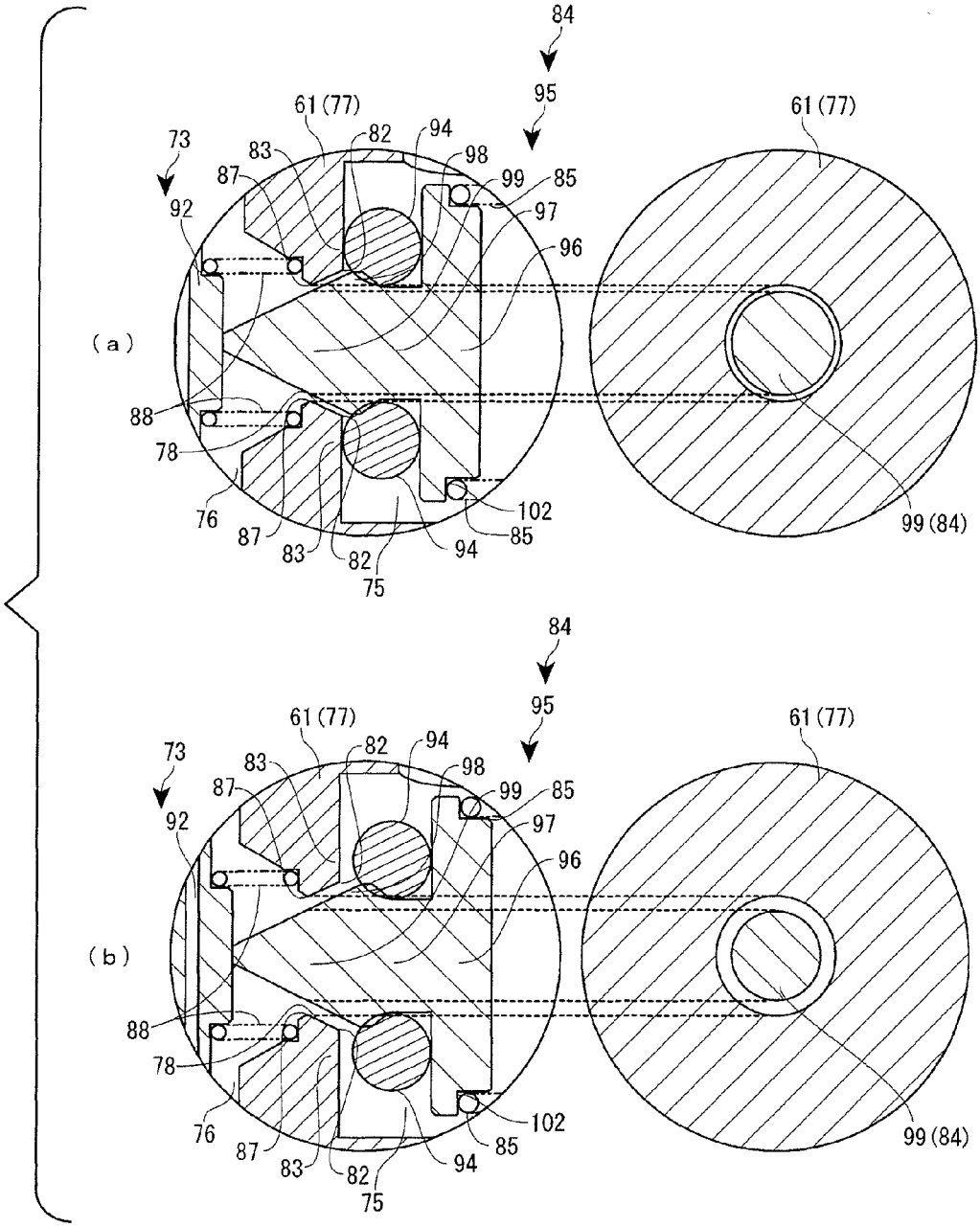
FIG. 10 is a view (1) showing the opening and closing operation of the pressure-regulating valve.
Figure 11:
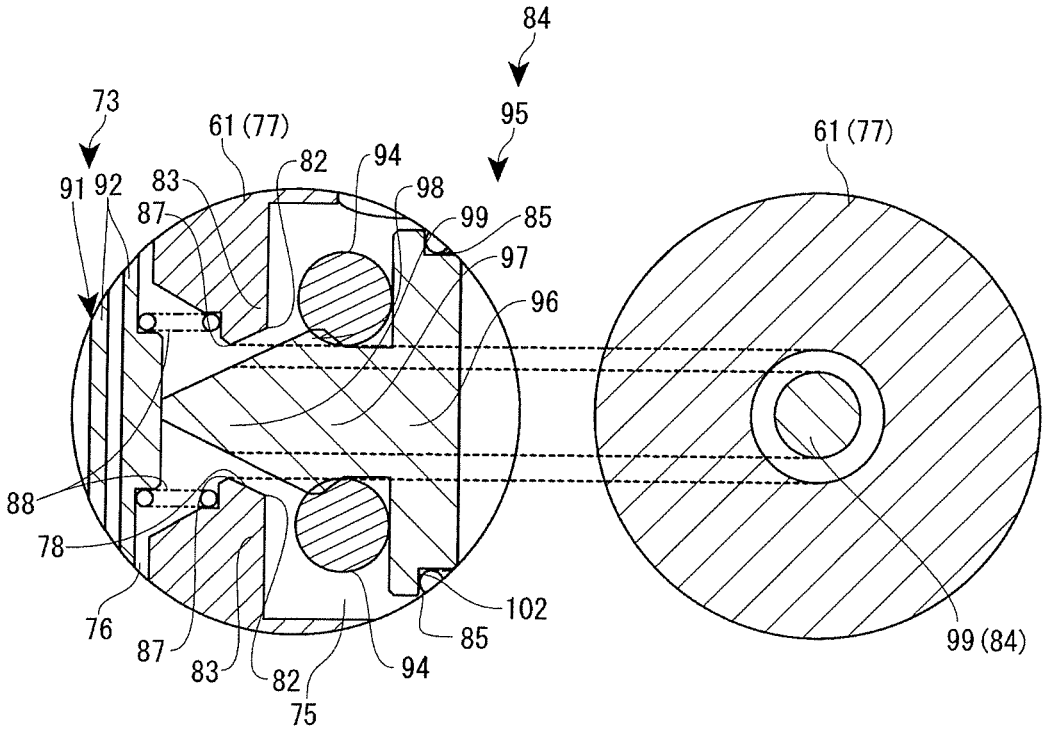
FIG. 11 is a view (2) showing the opening and closing operation of the pressure-regulating valve.

The opening and closing operation of the valve body 84 will next be described with reference to FIGS. 10 and 11. In the pressure-regulating valve 27 configured as described above, as the pressure of the secondary chamber 76 decreases due to ejection of liquid droplets by the functional droplet ejection heads 14, for example (see FIG. 10(*a*)), the pressure-receiving membrane 73 is concavely deformed by atmospheric pressure, and the pressure-receiving plate 92 pushes the valve body 84 toward the primary chamber 75 via the actuating shaft 99. At this time, the actuating shaft 99 retreats so that the peripheral surface thereof separates from the passage wall of the communication flow passage 78. At the same time, the valve main body 94 separates from the valve seat 83 into the open state (see FIG. 10(*b*)). When the valve body 84 thus opens, the functional liquid in the primary chamber 75 flows into the secondary chamber 76 via the communication flow passage 78, and the pressure of the secondary chamber 76 increases, whereby the pressure-receiving membrane 73 is convexly deformed toward the outside. At this time, the actuating shaft 99 is advanced by the urging force of the valve body urging spring 85, so that the peripheral surface of the actuating shaft 99 approaches the passage wall of the communication flow passage 78. At the same time, the valve main body 94 is brought into contact with the valve seat 83 by the spring force of the valve body urging spring 85, and the valve is closed.

When the functional liquid is forcibly suctioned during cleaning or initial filling of the functional liquid, since a large quantity of functional liquid is suctioned, the negative pressure of the secondary chamber 76 increases with corresponding rapidity, and the valve is at the maximum degree of opening. Although a large quantity of functional liquid flows into the communication flow passage 78 in this case, since the size of the communication flow passage 78 is further increased according to the degree of opening of the valve (see FIG. 11) the functional liquid can be caused to flow into the secondary chamber 76 with no loss of pressure.

The pressure-regulating valve 27 thus opens and closes the communication flow passage 78 by the deformation of the pressure-receiving membrane 73 according to the balance between atmospheric pressure and the internal pressure of the secondary chamber 76 that is connected to the functional droplet ejection heads 14. Forces are distributed between the valve body urging spring 85 and the membrane urging spring 88, and the valve body 84 is opened and closed extremely slowly by the elastic force of the valve main body 94. Pressure fluctuation (cavitation) due to opening and closing of the valve body 84 is therefore suppressed, and ejection by the functional droplet ejection heads 14 is unaffected.

Through the configuration described above, since the actuating shaft 99 and the communication flow passage 78 are both formed so as to taper to a point toward the pressure-receiving membrane 73, there is no sliding resistance when the valve body 84 is opened, and the valve body 84 can be smoothly opened and closed. Since the cross-sectional area of the communication flow passage 78 also changes according to the degree of opening of the valve body 84, the predetermined functional liquid can be fed to the secondary chamber 76 without pressure loss regardless of the amount of functional liquid that is flowing.

What is claimed is:

1. A pressure-regulating valve comprising:

a communication flow passage formed through a barrier that partitions a primary chamber and a secondary chamber inside a valve housing;

a valve body that opens and closes the communication flow passage, an edge of a primary-chamber-side opening of the barrier in which the communication flow passage is formed being a valve seat; and a pressure-receiving membrane that forms one surface of the secondary chamber, and opens and closes the valve body based on atmospheric pressure, the pressure of a functional liquid fed to the primary chamber from functional liquid feeding means being regulated by opening and closing the valve body, the functional liquid is fed to the secondary chamber, and the functional liquid is fed from the secondary chamber to an inkjet-type functional droplet ejection head, wherein the valve body has a valve body main body that directly opens and closes with respect to the valve seat, the valve body main body being provided to the primary chamber, and a valve holder including a holding part that holds the valve body main body and an actuating shaft that comes in contact with the pressure-receiving membrane, the actuating shaft extending concentrically through the communication flow passage from the holding part, the actuating shaft is formed so as to taper to a point toward the pressure-receiving membrane, and the communication flow passage is formed to have a complementary shape with respect to the actuating shaft such that the functional liquid flows between the actuating shaft and the communication flow passage toward a distal end of the actuating shaft from the primary chamber to the secondary chamber while the valve body main body is separated from the valve seat.

2. The pressure-regulating valve according to claim 1, wherein the valve body main body includes an O-ring, and a retaining part of the valve body main body formed as an extension of the actuating shaft is formed at the boundary between the holding part and the actuating shaft.

3. A liquid droplet ejection apparatus comprising:

the pressure-regulating valve according to claim 1;

the functional liquid feeding means; and the functional droplet ejection head, wherein a functional liquid is ejected onto a workpiece and drawing is performed while the functional droplet ejection head is moved relative to the workpiece.

4. A pressure-regulating valve comprising:

a communication flow passage formed through a barrier that partitions a primary chamber and a secondary chamber inside a valve housing;

a valve body that opens and closes the communication flow passage, an edge of a primary-chamber-side opening of the barrier in which the communication flow passage is formed being a valve seat; and a pressure-receiving membrane that forms one surface of the secondary chamber, and opens and closes the valve body based on atmospheric pressure, the pressure of a functional liquid fed to the primary chamber from functional liquid feeding means being regulated by opening and closing the valve body, the functional liquid is fed to the secondary chamber, and the functional liquid is fed from the secondary chamber to an inkjet-type functional droplet ejection head, wherein the valve body has a valve body main body that directly opens and closes with respect to the valve seat, the valve body main body being provided to the primary chamber, and a valve holder including a holding part that holds the valve body main body and an actuating shaft that comes in contact with the pressure-receiving membrane, the actuating shaft extending concentrically through the communication flow passage from the holding part, the actuating shaft is formed so as to taper to a point toward the pressure-receiving membrane, the communication flow passage is formed to have a complementary shape with respect to the actuating shaft, and the actuating shaft is inserted so that a small gap is formed with the communication flow passage in a closed-valve state in which the valve body main body is in close contact with the valve seat.

* * * * *